US005274382A

United States Patent [19]

Wills et al.

[11] Patent Number: 5,274,382

[45] Date of Patent: Dec. 28, 1993

[54] ANTENNA SYSTEM FOR TRACKING OF SATELLITES

[75] Inventors: Jack D. Wills, El Segundo; Norman L. Hannon, Northridge, both of Calif.

[73] Assignee: Datron Systems, Incorporated, Simi Valley, Calif.

[21] Appl. No.: 27,394

[22] Filed: Mar. 8, 1993

Related U.S. Application Data

[63] Continuation of Ser. No. 908,360, Jul. 6, 1992, abandoned.

[51] Int. Cl.[5] ..... H01Q 3/00

[52] U.S. Cl. ..... 342/359; 342/425; 342/426

[58] Field of Search ..... 342/359, 425, 426, 75; 318/649; 343/703; 364/459

[56] References Cited

U.S. PATENT DOCUMENTS 5,043,737 8/1991 Dell-Imagine ..... 342/358
5,077,560 12/1991 Horton et al. ..... 342/359
5,077,561 12/1991 Gorton et al. ..... 342/359
5,163,176 11/1992 Flumerfelt et al. ..... 342/174

*Primary Examiner*—Theodore M. Blum
*Attorney, Agent, or Firm*—Edward A. Sokolski

[57] ABSTRACT

In an antenna system for tracking a satellite, a prediction of the angular orientation of the satellite relative to the antenna as a function of time is obtained from the orbital parameters of the satellite. The mechanisms for controlling the angular position of the entire antenna structure then "drive" the entire structure so as to point the antenna beam towards the predicted position of the satellite as the satellite progresses in its orbit. The "drive" instructions are perturbed slightly so as to cause the antenna beam to "dither" slowly about the predicted satellite positions. The variations in signal strength produced by the dither are then used to determine the azimuth and elevation errors. The orbital parameters upon which the predictions are based are then adjusted so as to minimize the observed azimuthal and elevation errors. Because any error in the orbital parameters changes only very slowly, a relatively slow "dither" and a long time constant can be used in the correction process.

17 Claims, 1 Drawing Sheet

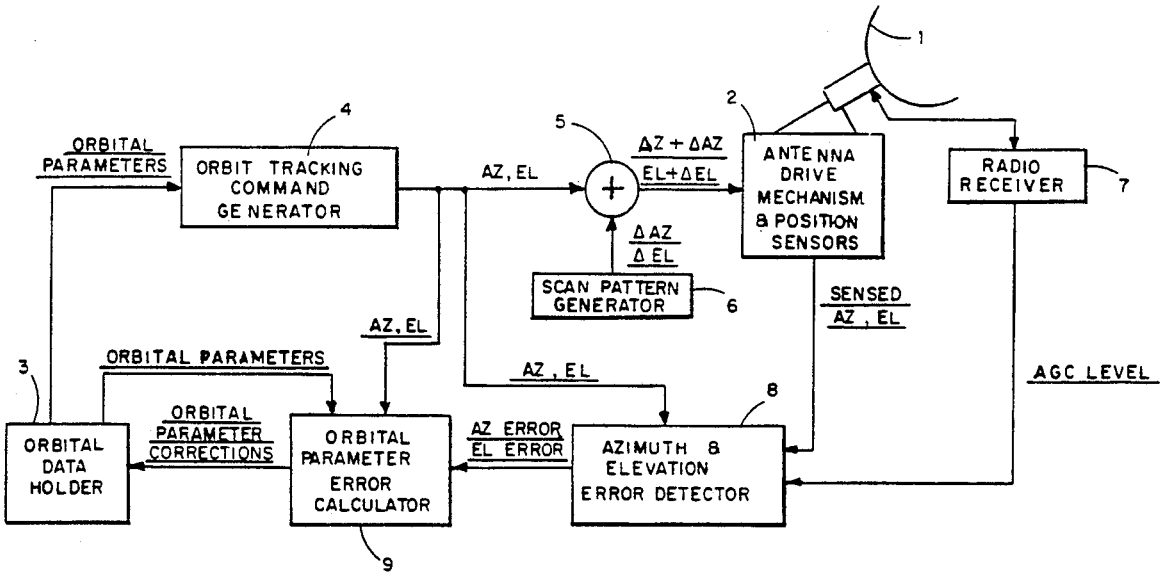

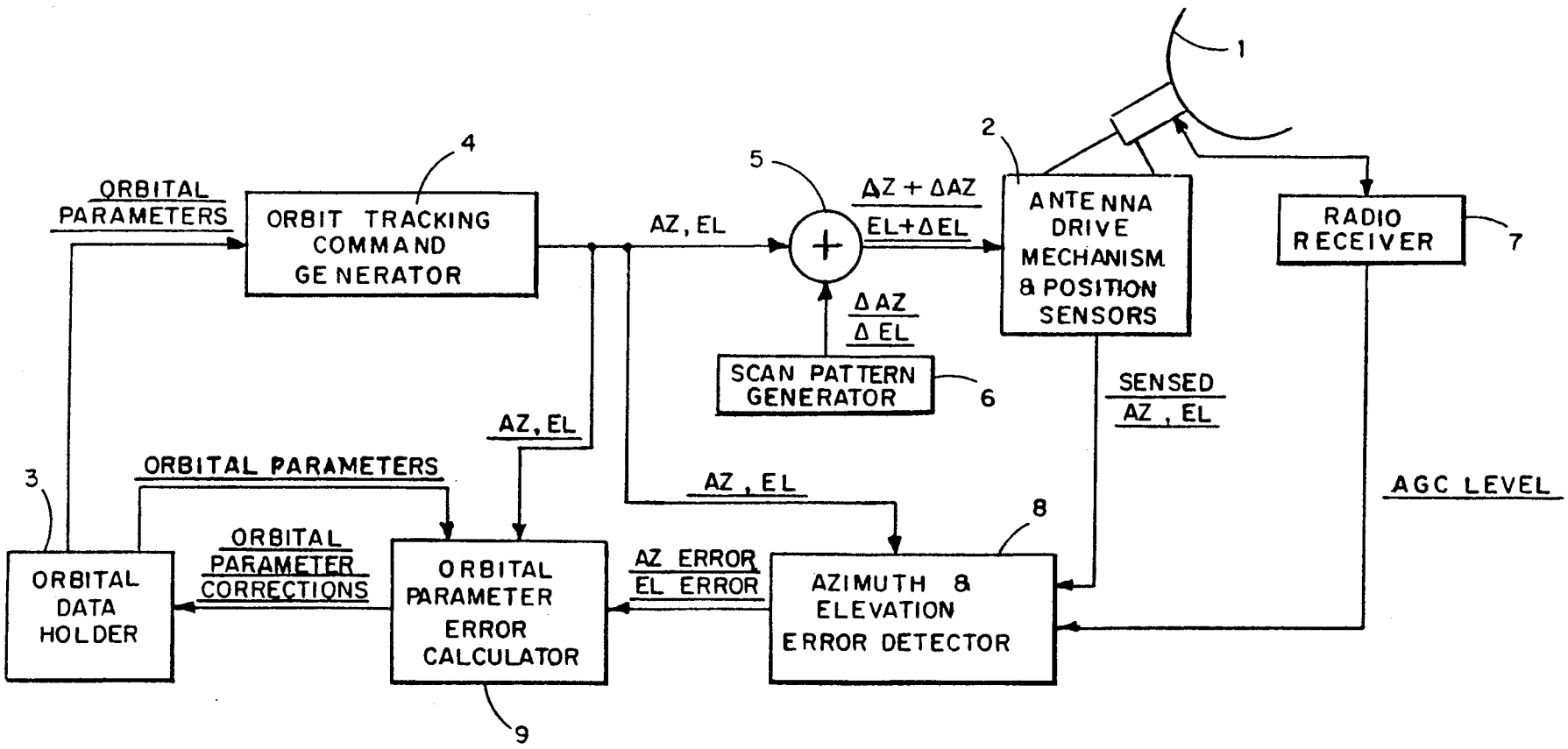
RADIO RECEIVER
7
AGC LEVEL
1
ANTENNA DRIVE MECHANISM & POSITION SENSORS
2
SENSED AZ, EL
AZIMUTH & ELEVATION ERROR DETECTOR
8
ΔAZ + ΔAZ
EL+ΔEL
ΔAZ
ΔEL
SCAN PATTERN GENERATOR
6
5
AZ, EL
AZ, EL
AZ ERROR
EL ERROR
ORBIT TRACKING COMMAND GENERATOR
4
AZ, EL
ORBITAL PARAMETER ERROR CALCULATOR
9
ORBITAL PARAMETERS
ORBITAL PARAMETER CORRECTIONS
ORBITAL PARAMETERS
ORBITAL DATA HOLDER
3

ANTENNA SYSTEM FOR TRACKING OF SATELLITES

This is a continuation of Ser. No. 108,360, filed Jul. 6, 1992, now abandoned.

BACKGROUND OF THE INVENTION a. Field of the Invention

This invention pertains to antennas systems used for tracking a satellite or other source of a radio signal.

More particularly, this invention pertains to antenna systems which determine the angular position of the satellite relative to the antenna from the variation of the strength of the radio signal that is received from the satellite as the direction of the antenna is altered relative to the satellite.

b. Description of the Prior Art

In one example of the prior art, an antenna consisting of a main reflector, a subreflector and a feed was utilized to produce a "beam" of sensitivity to incident radio signals. Azimuth and elevation drive mechanisms were used to alter the angular orientation of the entire antenna structure so as to point the "beam" in a desired direction. In addition, the position of the subreflector was mechanically oscillated or "wobbled" relative to the main reflector so as to cause the beam of sensitivity to be scanned in a conical manner about the nominal, central beam position. The strength of the radio signal that was received from a satellite varied as a consequence of the conical movement of the beam and this variation in signal strength was used to determine the angular position of the satellite relative to the central beam location.

Typically, in the prior art the variation (or imbalance) in signal strength that was produced by the conical scan of the beam was "fed back" directly to the azimuth and elevation drive mechanisms so as to alter the angular orientation of the entire antenna structure in a direction that would reduce the variation in signal strength that was produced by the conical scanning of the beam about the central position. The time constants of such "feedback" systems, however, were severely limited by the tracking rates that had to be produced by the drive mechanisms in the feedback system in order to track a satellite whose angular position relative to the antenna was changing rapidly. As a consequence the feedback system had to have a relatively short time-constant in order to be able to cause the angular orientation of the antenna to change, or "slew", at a sufficiently high rate to follow or track the movement of the satellite. This short time-constant imposed significant operational restrictions upon the signal to noise ratio of the received signal that was required for successful operation of the tracking antenna.

When the antenna system is used to track a satellite whose orbital parameters are known (at least approximately), an improved prior art system has been used which utilizes the orbital parameters to predict the altitude and elevation of the satellite relative to the antenna. The altitude and azimuth of the tracking antenna are then driven in accord with the orbital predictions. The conical scan of the beam that is produced by the wobbling of the subreflector produces azimuthal and elevation error signals that are fed back respectively to the azimuth and elevation drive mechanisms to correct for errors in the prediction. If, however, the relative location of the satellite passes near the azimuthal axis of the antenna, high feedback rates, and fast responses from the drive mechanisms are required to maintain tracking.

Instead of producing a conical scan of the antenna beam about the predicted path of the satellite, another prior art antenna system has, in effect, approximated the conical scan by adding a small perturbation to the predicted values (as a function of time) of the altitude and elevation of the satellite relative to the antenna, and then sending steering commands to the drive mechanisms of the antenna in accord with these perturbed predictions. As a consequence the antenna (and its beam) was caused to scan about the predicted path in approximately a conical fashion. The variations in signal strength produced by these perturbations were then fed back respectively to the azimuth and elevation drive mechanisms. Here again, however, if the relative location of the satellite passes near the azimuthal axis of the antenna, high feedback rates, and fast responses from the drive mechanisms are required to maintain tracking. The mechanical "backlash" (sometimes referred to as "play") that is present in antenna drive mechanisms and other forces, such as wind loading caused the actual positions of the prior art antenna (and the antenna beam) to deviate slightly from the positions specified by the steering commands, which deviations degraded the operation of the feedback system.

SUMMARY OF THE INVENTION

In the present invention the azimuth and elevation of the antenna are "driven" in accord with the predictions based upon the satellite's orbital parameters. A small perturbation is superimposed upon the azimuth and elevation steering instructions so as to cause the antenna and its beam to be scanned slightly away from (i.e. to "dither" about) the predicted position of the satellite. In the present antenna, position sensors attached to the antenna structure are used to determine the orientation or position of the antenna and the antenna beam. (For the purposes of simplicity in description, the position or angular orientation of the antenna is considered in this specification to be the same as the position or angular orientation of the antenna beam and the terms are used interchangeably.) Instead of comparing the variations in the received signal strength with the perturbations in the steering instructions to determine the actual location of the satellite relative to the antenna, the present invention, instead, compares the variations in signal strength with the measured or sensed positions of the antenna and thus compares the variations in signal strength with the actual deviations of the antenna's azimuth and elevation from the predicted values of the satellite's position to determine the satellite's actual position. By using the measured values of the antenna position rather than the positions specified by the steering commands, this invention avoids the errors that otherwise would be introduced by disturbances such as wind loading that may cause the actual positions of the antenna to differ from the "commanded" positions.

Instead of using the variations in received signal strength to determine the error in azimuth and elevation and then feeding these errors directly back to the azimuth and elevation drive mechanisms, the present antenna system utilizes the error measurements to calculate and apply corrections to the orbital parameters for the satellite, which corrected orbital parameters are, in turn, used to predict the location of the satellite and thus are, in effect, fed back into the tracking system. Because the differences between the measured orbital parameters and the orbital parameters that are used for the prediction of the satellite path change relatively slowly and without regard to the orientation of the satellite orbit relative to the azimuthal axis of the antenna, the feed back mechanism of the present invention does not degenerate when a satellite orbit passes near the azimuthal axis of the tracking antenna. Furthermore, because the errors in the orbital parameters change only very slowly with time, the feedback system in the present invention can have a relatively long time constant and as a consequence the feedback system can operate successfully with a relatively low signal to noise ratio for the received signal. Finally, because of the relatively long time constant, a relatively slow "dither" can be applied to the azimuth and elevation of the antenna.

BRIEF DESCRIPTION OF THE DRAWINGS

The sole FIGURE is a functional block diagram of the invention.

DETAILED DESCRIPTION

Referring now to FIG. 1 which is a functional block diagram of the invention. The azimuth and elevation of antenna 1 is controlled by antenna drive mechanism and position sensors 2. In order to track a satellite, the orbital parameters of the satellite are stored in orbital data holder 3, which supplies the data parameters to orbit tracking command generator 4. Based upon the orbital parameters, orbit tracking command generator 4 calculates the azimuthal and elevation coordinates to which antenna 1 must be driven in order to point the beam of sensitivity of antenna 1 towards the satellite. These azimuthal and elevation coordinates are supplied through summer 5 to antenna drive mechanism 2 so as to drive antenna 1 so as to point its beam towards the predicted position of the satellite. The azimuthal and elevation coordinates, of course, change with time as the satellite moves in its orbit. The azimuthal and elevation coordinates generated by orbit tracking command generator 4 are also supplied to azimuth and elevation error detector 8.

The signal that is received from the satellite by antenna 1 is fed to receiver 7, which receiver 7, in turn, provides a measure of the signal strength of the received signal which measure is supplied to azimuth and elevation error detector 8. Typically, the signal strength is represented by the voltage level of the automatic gain control circuitry within the receiver.

Scan pattern generator 6 generates small perturbations to the predicted azimuthal and elevation coordinates, which perturbations are added to the predicted values in summer 5 to generate perturbed steering commands which perturbations cause the beam of antenna 1 to be offset slightly from the predicted position of the satellite in a preselected manner. The actual azimuth and elevation of the antenna are sensed by means of the position sensors within antenna drive mechanism 2 and the sensed values are supplied to azimuth and elevation error detector 8.

Azimuth and elevation error detector 8 compares the differences between the sensed actual values of the azimuth and elevation of antenna 1 and the azimuth and elevation values supplied by orbit tracking command generator 4 and compares these differences with the strength of the signal received from the satellite. By comparing these differences with the variation in signal strength as they change with time, error detector 8 obtains and provides a measure of the amounts by which the actual values of azimuth and elevation of the satellite (as a function of time) differ from the values predicted (calculated) from the orbital parameters and outputs the error in azimuth and elevation to orbital parameter error calculator 9.

In the preferred embodiment, the errors in azimuth and elevation may be measured and calculated by application of the following equations.

For a tracking antenna situated on earth, the conventional practice is to use an azimuth and elevation coordinate system in which the azimuthal axis is aligned with the local gravity vector and an azimuth of zero degrees is aligned 0 with true north. For simplicity in the following mathematical analysis, however, the coordinates, Az and El, are orthogonal angular coordinates measured relative to the center of the beam of the antenna. Although the following analysis utilizes an orthogonal coordinate system, the physical scan mechanisms in the actual antenna system, of course, need not be orthogonal.

For a time-dependent dither in Az and El that occurs over a period of time T, the bias in the dither is defined as:

$$Az_{bias} = \frac{1}{T}\int_0^T Az_{scan}(t)dt \tag{1}$$

$$El_{bias} = \frac{1}{T}\int_0^T El_{scan}(t)dt \tag{2}$$

The zero mean scan patterns $Az_{scan}(t)$ and $El_{scan}(t)$ are given by:

$$\widetilde{Az}_{scan}(t) = Az_{scan}(t) - Az_{bias} \tag{3}$$

$$\widetilde{El}_{scan}(t) = El_{scan}(t) - El_{bias} \tag{4}$$

The following integrals involving the zero mean scan patterns are defined as:

$$I_{a2} = \int_0^T (\widetilde{Az}_{scan}(t))^2\, dt \tag{5}$$

$$I_{a3} = \int_0^T (\widetilde{Az}_{scan}(t))^3\, dt \tag{6}$$

$$I_{e2} = \int_0^T (\widetilde{El}_{scan}(t))^2\, dt \tag{7}$$

$$I_{e3} = \int_0^T (\widetilde{El}_{scan}(t))^3\, dt \tag{8}$$

$$I_{ae} = \int_0^T (\widetilde{Az}_{scan}(t))(\widetilde{El}_{scan}(t))\, dt \tag{9}$$

$$I_{a2e} = \int_0^T (\widetilde{Az}_{scan}(t))^2(\widetilde{El}_{scan}(t))\, dt \tag{10}$$

$$I_{ae2} = \int_0^T (\widetilde{Az}_{scan}(t))(\widetilde{El}_{scan}(t))^2\, dt \tag{11}$$

Assuming that the antenna beam has approximately a parabolic shape near its axis, then the variation in the received power level as a function of beam radial error is:

$$P_{rx} = k - 12\left(\frac{\theta}{\theta_{hp}}\right)^2 \text{ decibels} \tag{12}$$

In the preferred embodiment, the automatic gain control ("AGC") voltage in the radio receiver is used as an indicator of received signal strength. Assuming that within the range in which the tracking measurements are made, the AGC voltage varies linearly in proportion to the power level of the received signal with a scale factor, s, then the received voltage, Vrx is:

$$V_{rx} = sP_{rx} = s\left(k - 12\left(\frac{\theta}{\theta_{hp}}\right)^2\right) = sk - \frac{12s}{\theta_{hp}^2}\theta^2 \tag{13}$$

For small angles $\theta$ may be expressed approximately as:

$$\theta = \sqrt{(Az_{scan}(t) - Az_{error})^2 + (El_{scan}(t) - El_{error})^2} \tag{14}$$

$$\theta = \sqrt{(\widetilde{Az}_{scan}(t) + Az_{bias} - Az_{error})^2 + (\widetilde{El}_{scan}(t) + El_{bias} - El_{error})^2} \tag{15}$$

where $Az_{error}$ and $El_{error}$ represent the angular error in the position of the satellite relative to the antenna beam in the absence of dither.

The received voltage may then be expressed as:

$$V_{rx}(t) = sk - \frac{12s}{\theta_{hp}^2}[(\widetilde{Az}_{scan}(t) + Az_{bias} - Az_{error})^2 + (\widetilde{El}_{scan}(t) + El_{bias} - El_{error})^2] \tag{16}$$

and after expanding the squares as:

$$V_{rx}(t) = sk - \frac{12s}{\theta_{hp}^2}[\widetilde{Az}^2_{scan}(t) + 2\widetilde{Az}_{scan}(t)(Az_{bias} - Az_{error}) + (Az_{bias} - Az_{error})^2 + \widetilde{El}^2_{scan}(t) + 2El_{scan}(t)(El_{bias} - El_{error}) + (El_{bias} - El_{error})^2] \tag{17}$$

The pointing errors can be calculated in terms of the correlation of the AGC voltage and the zero mean scan patterns. For this purpose let:

$$R_{Az} = \int_0^T \widetilde{Az}_{scan}(t)V_{Rx}(t)\,dt \tag{18}$$

$$= \int_0^T \Big\{ sk\widetilde{Az}_{scan}(t) - \frac{12s}{\theta_{hp}^2}[\widetilde{Az}^3_{scan}(t) + 2\widetilde{Az}^2_{scan}(t)(Az_{bias} - Az_{error}) + \widetilde{Az}_{scan}(t)\widetilde{El}^2_{scan}(t) + 2\widetilde{Az}_{scan}(t)\widetilde{El}_{scan}(t)(El_{bias} - El_{error}) + \widetilde{Az}_{scan}(t)(Az_{bias} - Az_{error})^2 + \widetilde{Az}_{scan}(t)(El_{bias} - El_{error})^2] \Big\} dt \tag{19}$$

Since $Az_{scan}$ (t) has a zero mean, many of the terms in the preceding expression are zero. By dropping these terms, and using the notation set forth in equations 1 to 11, one obtains $$R_{Az} = \frac{-12s}{\theta_{hp}^2}[I_{a3} + 2I_{a2}(Az_{bias} - Az_{error}) + I_{ae2} + 2I_{ae}(El_{bias} - El_{error})] \tag{20}$$

In a similar fashion with respect to elevation $$R_{El} = \int_0^T \widetilde{El}_{scan}(t)V_{Rx}(t)\,dt \tag{21}$$

which by similar manipulation becomes $$R_{El} = \frac{-12s}{\theta_{hp}^2}[I_{e3} + 2I_{e2}(El_{bias} - El_{error}) + I_{a2e} + 2I_{ae}(Az_{bias} - Az_{error})] \tag{22}$$

The simultaneous solution of equations (21) and (22) for ($Az_{bias} - Az_{error}$) and ($El_{bias} - El_{error}$), after some further manipulation yields $$El_{error} = El_{bias} + \frac{0.5}{I_{a2}I_{e2} - I_{ae}^2}\left[\frac{\theta_{hp}^2}{12s}(R_{El}I_{a2} - R_{Az}I_{ae}) + I_{ae}I_{e3} + I_{a2}I_{a2e} - I_{ae}I_{a3} - I_{ae}I_{ae2}\right] \tag{23}$$

and $$Az_{error} = Az_{bias} + \frac{0.5}{I_{a2}I_{e2} - I_{ae}^2}\left[\frac{\theta_{hp}^2}{12s}(R_{Az}I_{e2} - R_{El}I_{ae}) + I_{e2}I_{a3} + I_{e2}I_{ae2} - I_{ae}I_{e3} - I_{ae}I_{a2e}\right] \tag{24}$$

Of course for a conical scan, the preceding expressions are considerably simplified, and become $$El_{error} = \frac{0.5}{1-0}\,\frac{\theta_{hp}^2}{12s}R_{El} = \frac{\theta_{hp}^2}{6s}R_{El} \tag{25}$$

and $$Az_{error} = \frac{\theta_{hp}^2}{6s}R_{Az} \tag{26}$$

For a conical scan, the scaling term $$\frac{\theta_{hp}^2}{6s}R_{Az}$$

typically is determined from far field measurements of the antenna error slope.

Although the perturbations or "dither" applied to the predicted coordinates may be selected so as to approximate a conical scan about the predicted coordinates, the present invention is not limited to the use of a conical scan or dither. A more generalized perturbation or dither may instead be used. Furthermore, because the algorithms used for the calculation of the error in azimuth and elevation are not restricted to a conical dither about the predicted path, the actual sensed perturbations of the antenna positions can be used for the calculation of the errors in azimuth and elevation with respect to the predicted path. As a consequence, wind loading and backlash in the antenna drive mechanisms, which would cause the actual dither to depart from that specified by a conical-scan drive command, do not degrade the calculation of the errors in the prediction of the azimuth and elevation of the satellite relative to the antenna.

Orbital parameter error calculator 9 receives the azimuthal and the elevation error measurements from azimuth and elevation error detector 8, receives the orbital parameters (e.g. a, e, i, Ω, ω, T) from orbital data holder 3 and receives the predicted values of azimuth and elevation for the satellite from orbit tracking command generator 4. Orbital parameter error calculator 9 combines the azimuthal and elevation error measurements with the predicted values of azimuth and elevation to obtain a representation of the actual path of the satellite as a function of time. Calculator 9 then uses the orbital parameters that it receives from orbital data holder 3 to calculate a revised predicted path for the satellite and by means of iterative calculations then adjusts the values of the orbital parameters by small amounts so as to obtain a best fit by the revised predicted path to the observed path of the satellite. These small adjustments to the orbital parameters are then used to correct and update the orbital parameters in orbital data holder 3.

In the preferred embodiment, during the pass of the satellite, only the time of perifocal passage, T, and the longitude of the ascending node, omega, are altered in the iterative calculations in order to adjust the tracking of the satellite by the antenna. However, after the satellite has passed out of view, additional orbital parameters are adjusted in an expanded iterative process in order to improve the orbital predictions for the next pass of the satellite.

It should be understood that although for ease of description the invention has been described using the terms azimuth and elevation, an orthogonal angular coordinate system is not a necessary part of the invention. Accordingly, in this specification, the terms azimuth and elevation should be understood to include more general coordinate systems for defining directions in space.

I claim:

1. An antenna system for the tracking of a satellite by reducing errors in the pointing of the antenna system toward the satellite, the satellite being of the type having known orbital parameters, the orbital parameters comprising a set of orbital parameters that is suitable and sufficient to define the satellite's position in three dimensional space relative to the earth throughout the satellite's orbit about the earth, and radiating a radio signal, the antenna system including an antenna of the type having a beam and the beam having a known shape, the antenna system comprising:

an antenna having an antenna beam, orienting means for altering and controlling the angular position of the antenna and the antenna beam, orbital data holding means for holding the orbital parameters, angular prediction means for calculating a prediction of the angular position of the satellite relative to the antenna as a function of time, the prediction being based upon the orbital parameters, dither generating means for generating an angular perturbation and for combining the angular perturbation with the prediction of the angular position of the satellite to provide a perturbed angular prediction, controlling means for controlling the orienting means so as to orient the angular position of the antenna beam approximately in accord with the perturbed angular prediction, signal sensing means for sensing the strength of the satellite signal that is received by the antenna, computation means for comparing the strength of the satellite signal with the angular position of the antenna and the antenna beam and for calculating corrections to a preselected set of the orbital parameters based upon the comparison, the preselected orbital parameters then being adjusted in accord with the calculated corrections.

2. The antenna system of claim 1 wherein the angular position of the antenna is measured by sensors, the angular position of the antenna as measured by the sensor being used by the computation means to calculate the corrections to the preselected set of orbital parameters.

3. The antenna system of claim 1 wherein the orientating means comprises drive mechanisms for driving the azimuth and elevation of the antenna.

4. The antenna system of claim 2 wherein the orientating means comprises drive mechanisms for driving the azimuth and elevation of the antenna.

5. The antenna system of claim 1 wherein the computation means comprises:

first computational means for comparing the strength of the satellite signal with the angular position of the antenna and the antenna beam and for calculating errors in the angular position of the antenna beam relative to the satellite, and second computational means for calculating corrections to the orbital parameters based upon the errors in the angular position of the antenna beam relative to the satellite.

6. The antenna system of claim 1 wherein the dither generating means generates a non-conical angular dither.

7. The antenna system of claim 2 wherein the dither generating means generates a non-conical angular dither.

8. The antenna system of claim 3 wherein the dither generating means generates a non-conical angular dither.

9. The antenna system of claim 4 wherein the dither generating means generates a non-conical angular dither.

10. The antenna system of claim 5 wherein the dither generating means generates a non-conical angular dither.

11. A method for the tracking of a satellite with an antenna system, by reducing errors in the pointing of the antenna systems towards the satellite, the satellite being of the type having known orbital parameters, the orbital parameters comprising a set of orbital parameters that is suitable and sufficient to define the satellite's position in three dimensional space relative to the earth throughout the satellite's orbit about the earth, and radiating a radio signal, the antenna system including an antenna of the type having a beam and the beam having a known shape, the method comprising:

calculating a prediction of the angular position of the satellite relative to the antenna as a function of time, the prediction being based upon the orbital parameters, generating an angular perturbation and combining the angular perturbation with the prediction of the angular position of the satellite to provide a perturbed angular prediction, controlling the angular position of the antenna beam approximately in accord with the perturbed angular prediction, sensing the strength of the satellite signal that is received by the antenna, comparing the strength of the satellite signal with the angular position of the antenna and the antenna beam and calculating corrections to a preselected set of the orbital parameters based upon the comparison, adjusting the preselected set of orbital parameters in accord with the calculated corrections.

12. The method of claim 11 wherein the angular position of the antenna is measured by sensors.

13. The method of claim 11 wherein the angular position of the antenna beam is oriented by azimuth and elevation drive mechanisms.

14. The method of claim 11 wherein the step of comparing the strength of the satellite signal with the angular position of the antenna and the antenna beam and calculating corrections to a preselected set of the orbital parameters based upon the comparison comprises:

comparing the strength of the satellite signal with the angular position of the antenna and the antenna beam and calculating the errors in the angular position of the antenna beam relative to the satellite, and calculating corrections to a preselected set of the orbital parameters based upon the errors in the angular position of the antenna beam relative to the satellite.

15. The method system of claim 11 wherein the angular perturbation provides a non-conical dither in the pointing of the antenna and the antenna beam relative to the predicted path of the satellite.

16. An antenna system for the tracking of a satellite by reducing errors in the pointing of the antenna system toward the satellite, the satellite being of the type having known orbital parameters, the orbital parameters comprising a set of orbital parameters that is suitable and sufficient to define the satellite's position in three dimensional space relative to the earth throughout the satellite's orbit about the earth, and radiating a radio signal, the antenna system including an antenna of the type having a beam and the beam having a known shape, the antenna system comprising:

an antenna having an antenna beam, an antenna drive mechanism, said antenna drive mechanism altering and controlling the angular position of the antenna and the antenna beam, an orbital data holder holding the orbital parameters for the satellite, an orbit tracking command generator, said orbit tracking command generator receiving the orbital parameters from the orbital data holder and providing a prediction of the angular position of the satellite relative to the antenna as a function of time, the prediction being based upon the orbital parameters, a scan pattern generator, said scan pattern generator generating an angular perturbation and combining the angular perturbation with the prediction of the angular position of the satellite to provide a perturbed angular prediction, the antenna drive mechanism altering the angular position of the antenna and the antenna beam so as to orient the angular position of the antenna beam approximately in accord with the perturbed angular prediction, a radio receiver, said radio receiver sensing the strength of the satellite signal that is received by the antenna, an azimuth and elevation error detector, said azimuth and elevation error detector comparing the strength of the received satellite signal with the angular position of the antenna and calculating the errors in the predictions of the angular position of the satellite relative to the antenna, an orbital parameter error calculator, said orbital parameter error calculator calculating corrections to the orbital data based upon the existing orbital parameters, the predicted angular orientation of the satellite relative to the antenna and the observed errors in said predicted angular orientation, the preselected orbital parameters then being adjusted in accord with the calculated corrections.

17. The antenna system of claim 16 and further including position sensors, said position sensors sensing the angular position of the antenna and the sensed angular position be used by the azimuth and elevation error detector to calculate the errors in the predictions of the angular position of the satellite relative to the antenna.

* * * * *